US009354025B1

(12) United States Patent
Guirguis

(10) Patent No.: US 9,354,025 B1
(45) Date of Patent: May 31, 2016

(54) MODIFIED TAIL FIN

(71) Applicant: Raafat Guirguis, Fairfax, VA (US)

(72) Inventor: Raafat Guirguis, Fairfax, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 75 days.

(21) Appl. No.: 14/121,517

(22) Filed: Sep. 15, 2014

(51) Int. Cl.
*F42B 25/00* (2006.01)
*F41H 11/12* (2011.01)

(52) U.S. Cl.
CPC ..... *F41H 11/12* (2013.01)

(58) Field of Classification Search
CPC ..... F42B 6/003; F42B 10/06; F42B 10/08; Y10S 102/703; A63B 65/02
See application file for complete search history.

(56) References Cited

U.S. PATENT DOCUMENTS 3,085,511 A * 4/1963 Donner ..... F42B 10/06 244/3.24
3,152,545 A * 10/1964 Potts, Jr. ..... F42B 10/06 102/387
3,223,034 A * 12/1965 Robertson ..... F42B 10/06 102/384
3,727,861 A * 4/1973 Swann ..... F42B 12/625 102/385
4,995,573 A * 2/1991 Wallow ..... F42B 10/06 102/521
5,014,931 A * 5/1991 Mikhail ..... F42B 10/06 102/517
5,062,585 A * 11/1991 Mikhail ..... F42B 10/06 244/3.24
5,207,434 A * 5/1993 Oudekerk ..... F42B 6/003 473/586
5,223,667 A 6/1993 Anderson
6,401,591 B1 6/2002 Ross et al.
6,540,175 B1 4/2003 Mayersak et al.
6,748,842 B1 6/2004 Guirguis
6,758,772 B1 7/2004 Chambers et al.
6,978,967 B1 * 12/2005 Scheper ..... F42B 10/16 102/385
7,343,860 B2 3/2008 Michel et al.
7,726,244 B1 6/2010 Lloyd
7,856,928 B1 12/2010 Paulic
8,042,471 B2 10/2011 Michel et al.
8,047,135 B1 11/2011 Paulic et al.
8,151,710 B2 4/2012 Fu et al.
2012/0186479 A1 7/2012 Skidmore et al.

FOREIGN PATENT DOCUMENTS

WO WO2008/081168 A1 7/2008

OTHER PUBLICATIONS

Brian Almquist, "Standoff Systems and Technologies for Near Shore Mine Countermeasures (MCM)", Office of Naval Research, 2002.

* cited by examiner

*Primary Examiner* — Samir Abdosh
(74) *Attorney, Agent, or Firm* — Fredric J. Zimmerman

(57) ABSTRACT

A dart tail fin assembly includes a cylindrical dart body with a nose, a tail opposite the nose and an outer surface extending from the nose to the tail. A plurality of tail fins is attached to and spaced around the outer surface of the dart body. Each one of the tail fins includes a trailing edge aligned with the tail of the dart, a leading edge opposite the trailing edge toward the nose of the tail, a length from the trailing edge to the leading edge and a flat portion disposed at leading edge extending perpendicularly outward from the outer surface a first width. Each tail fin is detached from the outer surface of the dart body along a portion of the length extending back from the leading edge.

13 Claims, 4 Drawing Sheets

MODIFIED TAIL FIN

STATEMENT OF GOVERNMENT INTEREST

The invention described herein may be manufactured and used by or for the Government of the United States of America for Governmental purposes without the payment of any royalties thereon or therefore.

BACKGROUND OF INVENTION

1) Field of the Invention

The present invention is directed to countermine systems and, more particularly, to projectiles or darts designed to defeat landmines or naval mines.

2) Description of Prior Art

Projectiles such as darts are used to explode, disable or otherwise render ineffective unexploded ordinances and live mines including landmines and naval mines. In order to reach a given mine or ordnance, the projectile may have to penetrate through soil or water to reach the mine. After passing through the soil or water, the projectile also has to penetrate the mine casing in order to position the neutralizing or explosive material within the mine.

For example, a large quantity of projectiles or darts can be deployed from a missile launched from an aircraft. The darts fall to the ground or into the water covering the area where the mine or mines are located, and then penetrating sand, soil and/or water to reach the mine. Upon contact, a dart penetrates the mine casing and is triggered, delivering the neutralizing material or detonating the explosive payload.

There is a need for an improved anti-mine dart that effectively and reliably detonates mines while having a reduced cost of manufacture and a reduced likelihood of inadvertent detonation, that is, a premature detonation. An inadvertent detonation may occur before the dart penetrates enough through the mine casing, or a delayed detonation may occur after the dart has over-penetrated and gone completely through the mine.

SUMMARY OF THE INVENTION

Exemplary embodiments of systems and methods in accordance with the present invention are directed to a countermine system that utilizes a projectile or dart having modified tail fins that improve the reliability of triggering the dart at the correct depth of penetration, that is, controls penetration of the dart into the mine. Subsequently, the trigger mechanism is activated within the dart. The modified tail fins provide more reliable triggering while producing a minimal affect on other features of the dart design including spinning, close packing and dart total weight.

The modified tail fin arrangement is applied to each individual fin and utilizes several elements including detachment of the fin from the body of the dart along a portion of the fin length, a flat leading edge of the fin and a tapered width of the dart from the flat leading edge along the outer edge of the fin. In an exemplary embodiment, the taper extends a length equal to the portion of the fin length that is detached from the body of the dart.

In one exemplary embodiment, each fin is not completely attached to the dart body along an axial extent running along a length of the dart body from the leading edge of the fin to the tail of the dart body. This configuration yields a narrow space, such as, a gap, or slit between the fin and the dart body starting from a front or leading edge of the fin and extending toward a back of trailing edge of the fin adjacent the tail of the dart body.

The combination of the flat leading edge and detached portion, that is, the gap, facilitates the fin bending at a point along its length where the slit begins as soon as the lower edge of the fin contacts the cover or casing of the explosive filled mine. As the dart body penetrates further into the mine, the bending progresses until the section of the length of fin along the length of the slit is effectively sitting flat on the mine casing. Because bending of the fin reduces the ability of the fins to penetrate through the cover, a force is imparted on the fin and transmitted through the part of the fin attached to the dart body in a direction toward the tail of the dart body, triggering the initiation process. The triggering is achieved when the dart decelerates as a result of this force and an internal floating mass keeps moving forward due to its inertia. Triggering of the initiation process may be adjusted to occur before or after the bending angle of the fin has progressed to an extreme by adjusting the strength of the spring holding the internal floating mass in place.

In another exemplary embodiment, the fins are slightly tilted, integrating a small aerodynamic angle of attack directly into each fin. The angle is small enough that the fin is nearly orthogonal to the cover upon impact. This slight tilt assists in initiating the bending sequence as opposed to relying solely on buckling, which is an unforced instability in a purely orthogonal impact.

The leading edge of the fin is altered from a pointed edge to an edge incorporating a small flat section extending perpendicularly, i.e., radially, from the dart body. This configuration further discourages penetration of the fin through the mine casing. It further ensures a good purchase of the lower edge into the mine casing to generate sufficient force to initiate bending of the fin along the section that is detached from the dart body. This force is generated into the lower edge upon contact with the casing, but is communicated throughout the fin material at the speed of sound. The speed of sound is several times higher than the dart velocity. Therefore, the section of the fin extending along the detached portion of the slit feels the bending moment and starts bending immediately upon contact of the fin lower edge with the mine casing.

The width of the fin, i.e., the distance the fin extends away or radially outward from the dart body, includes a portion that is tapered. This portion starts at the leading edge of the fin and extends along the fin to a point along the length of the fin, and more particularly the point at which the slit begins. This configuration reduces the forces on the lower part of the fin during penetration through water and a sand burden. It avoids the premature bending of the fin prior to contact with and penetration through the mine casing.

BRIEF DESCRIPTION OF THE DRAWINGS

It will be understood that many additional changes in details, materials, steps, and arrangements of parts which have been described herein and illustrated in order to explain the nature of the invention, may be made by those skilled in the art within the principle and scope of the invention as expressed in the appended claims.

DETAILED DESCRIPTION OF THE INVENTION

In the description which follows, any reference to either direction or orientation is intended primarily and solely for purposes of illustration and is not intended in any way as a limitation on the scope of the present invention. Also the particular embodiments described herein, although being exemplary, are not to be considered as limiting of the present invention.

Figure 1:
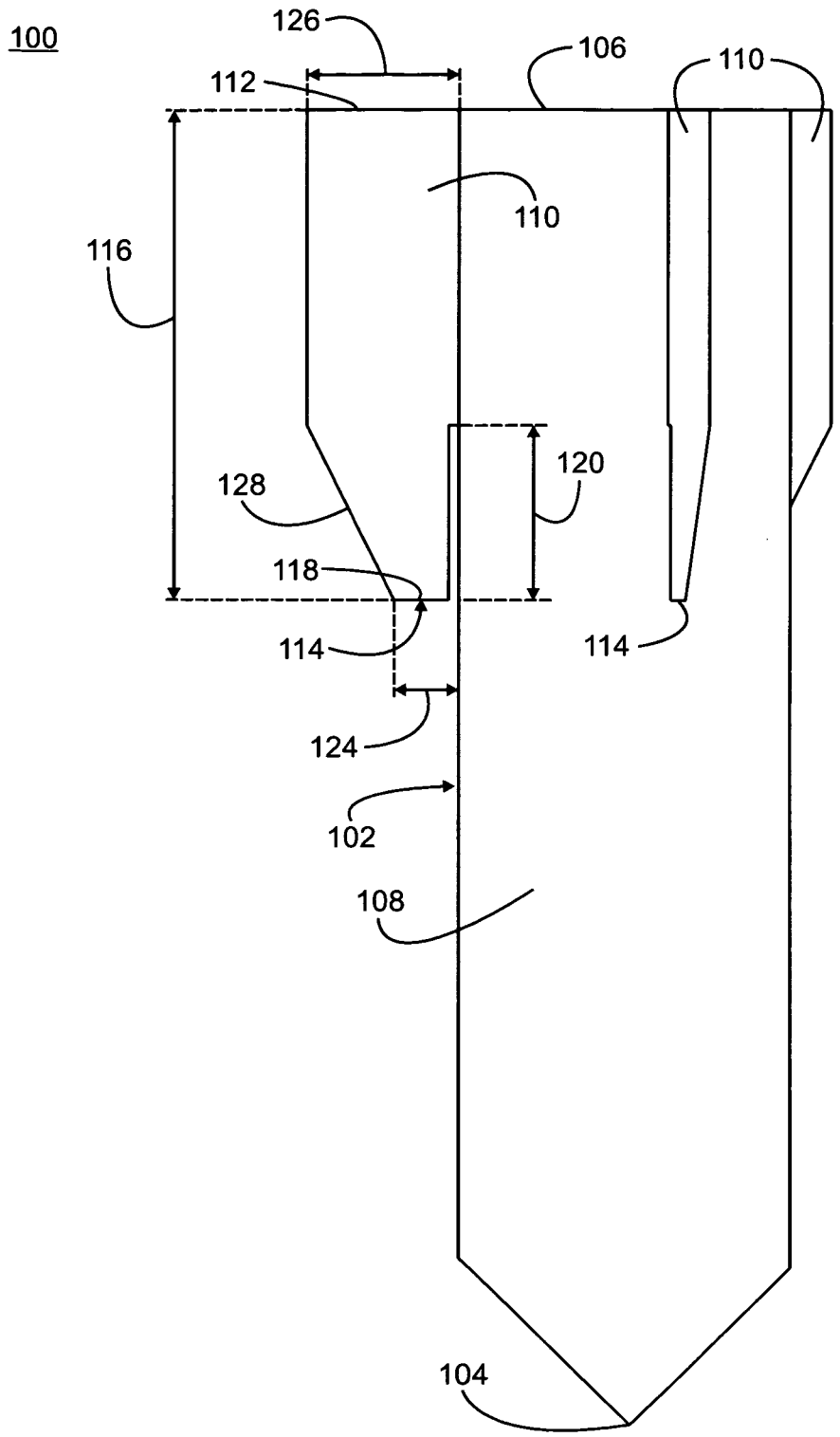
FIG. 1 is an illustration of an exemplary embodiment of a dart tail fin assembly in accordance with the present invention.

Referring initially to FIG. 1, exemplary embodiments in accordance with the present invention are directed to a dart or projectile tail fin assembly 100 that provides for improved penetration through the casing of a mine or other ordinance with improved reliability of triggering the dart at the correct depth of penetration. Afterwards triggering of the active components of the dart occurs.

The tail fin assembly includes a cylindrical dart body 102 having a nose 104, a tail 106 opposite the nose and an outer surface 108 extending from the nose to the tail. Suitable arrangements of darts and projectiles, which are known and available in the art, are deployed to inactivate or detonate mines and unexploded ordinances located either on the surface of the ground or under an overburden such as soil, sand and/or water. Generally, the dart body is elongated, and the nose is tapered and either rounded or pointed to provide for efficient penetration of the water or soil overburden surrounding the mine or ordinance. In an exemplary embodiment, the nose is a pointed nose shape.

In one exemplary embodiment, the assembly also includes a trigger mechanism located within the tail of the dart. Suitable tail-based triggers are known and available in the art. The payload of the assembly may be one or more energetic materials, or one or more chemicals capable of inactivating energetic materials. Any suitable energetic material or deactivating chemical known in the art may be used. These payloads are disposed within the dart body generally located anywhere between the nose and the tail. The trigger mechanism initiates the energetic material or releases the chemical upon activation, which detonates or inactivates the deployed mine.

The assembly includes a plurality of tail fins 110. Suitable numbers of tail fins include at least three or four tail fins. In an exemplary embodiment, the tail fins are evenly spaced around the outer cylindrical surface of the dart body. Each tail fin 110 is attached to and spaced around the outer surface of the dart body. Suitable methods for attaching the tail fin to the outer surface of the dart body include, but are not limited to, welds, adhesives and fasteners. Each tail fin 110 includes a trailing edge 112 aligned with the tail of the dart, a leading edge 114 opposite the trailing edge, toward the nose 104 of the dart, a length 116 from the trailing edge 112 to the leading edge 114, and a flat portion 118 disposed at the leading edge and extending perpendicularly, i.e., extending radially, outward from the outer surface 108 of the dart body 102 by a first width portion 124.

Figure 2:
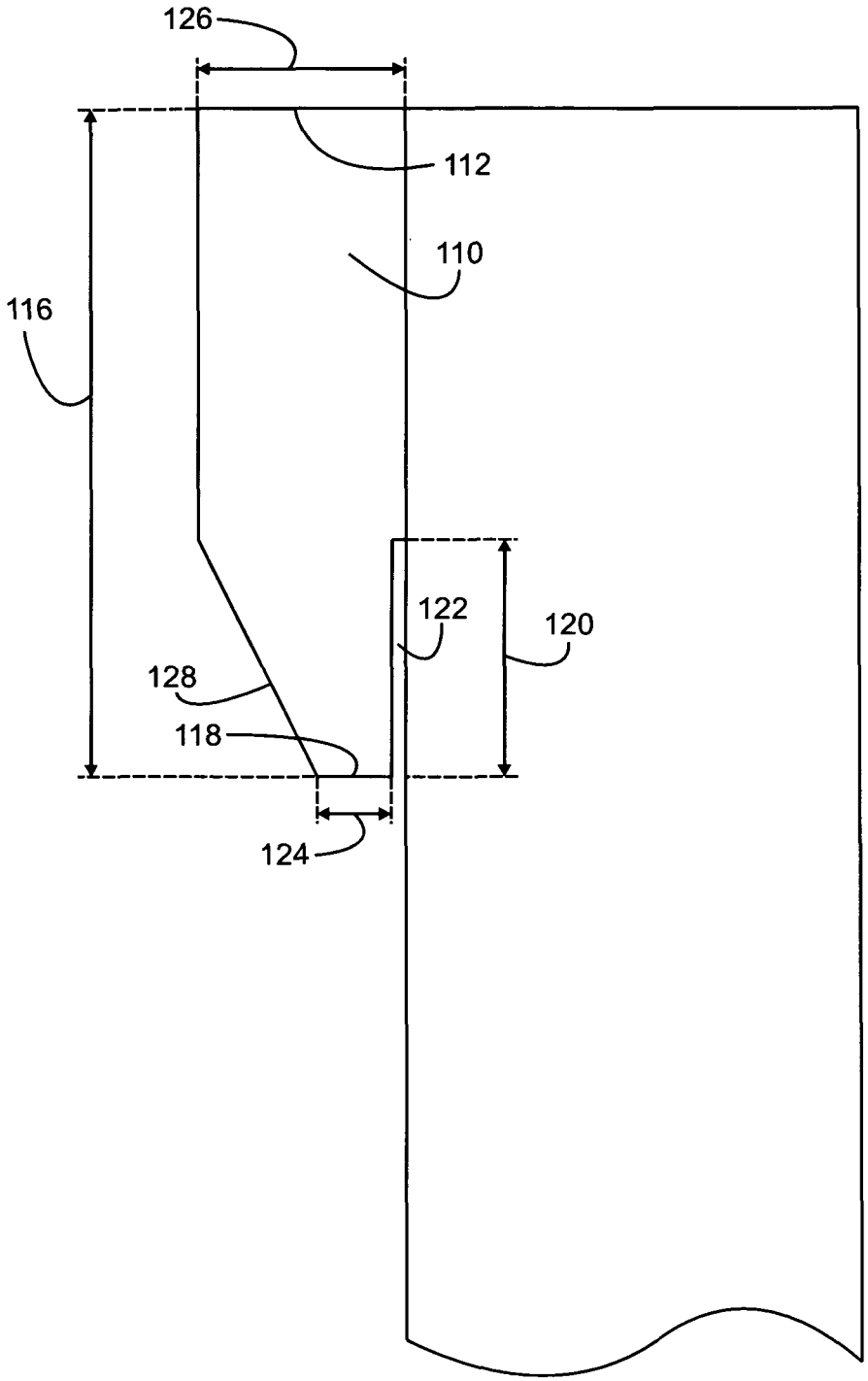
FIG. 2 is an illustration of a single fin of the dart tail fin assembly.

Referring to FIGS. 1 and 2, each tail fin 110 is detached from the outer surface of the dart body along a portion 120 of the length 116 extending from the leading edge, defining a gap 122 between each fin and the dart body. In an exemplary embodiment, the gap is about 100 micrometers. Suitable sizes for the gap 122 permit unobstructed movement of the tapered portion relative to the outer surface of the dart body while not interfering with the aerodynamics and flight of the dart. In one exemplary embodiment, the portion of the length that is detached is up to about ¼ or up to about ⅓ of the overall length of each fin. In addition, each fin extends perpendicularly, i.e., radially, outward from the outer surface 108 by a second width 126 at its trailing edge. The second width 126 is greater than the first width 124. Each dart fin further includes a tapered section 128 extending from the leading edge at a point on the leading edge opposite the outer surface of the dart body toward the trailing edge. The tapered section has a width that changes from the first width to the second width along a given distance from the leading edge. In an exemplary embodiment, this given distance equals the portion of the length 120 over which each fin is detached from the outer surface of the dart body thus defining a forward tapered portion of each fin.

Figure 3:
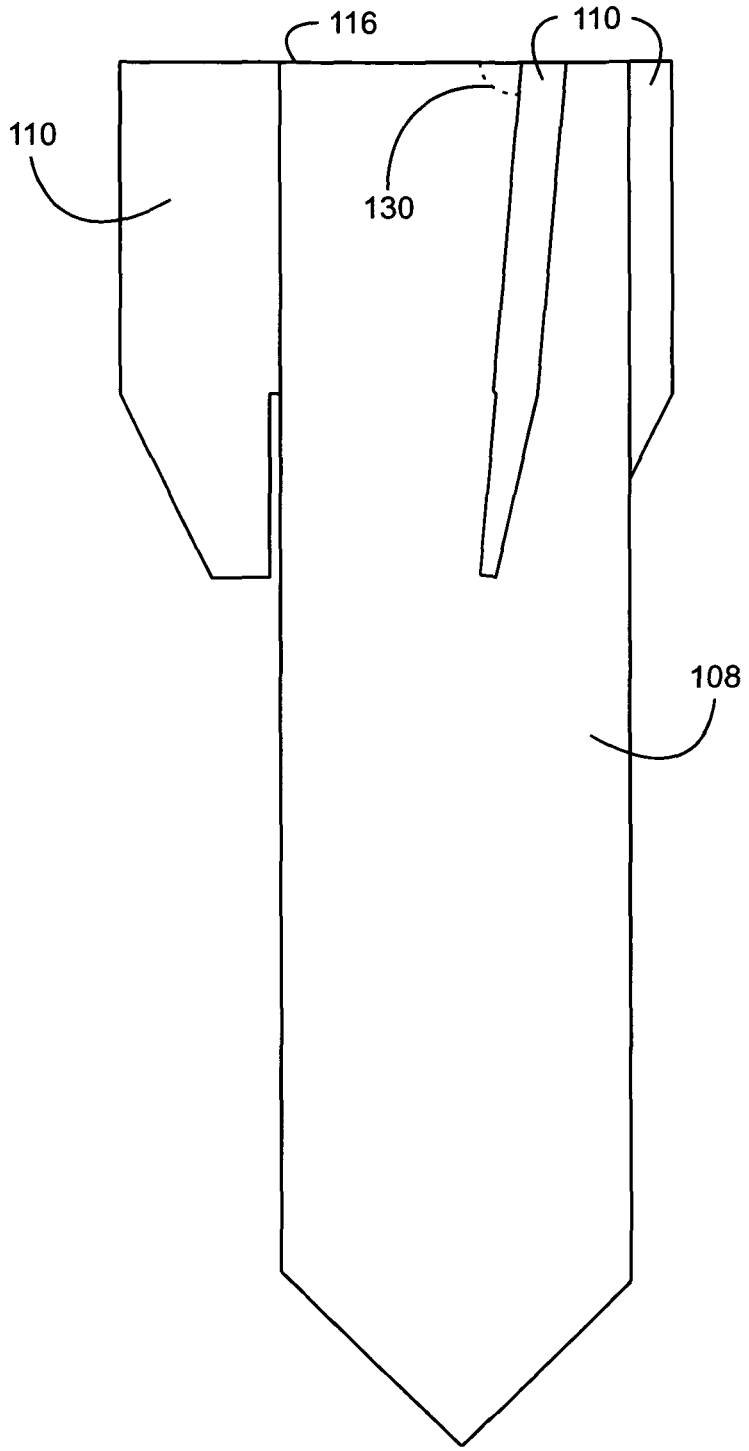
FIG. 3 is an illustration of another exemplary embodiment of the dart and tail fin assembly with each tail fin extending from the tail of the dart at an angle other than 90 degrees.

While each fin may extend perpendicularly, that is, about 90 degrees, from the tail along the length or height of the dart body, in another exemplary embodiment as illustrated in FIG. 3, each tail fin may extend from the tail along the length at an angle 130, that is, an angle to the axis of the dart, which is other than a 90 degrees angle. In an exemplary embodiment, the angle may be in a range of about 5 degrees to about 15 degrees (about 5 degrees-about 15 degrees). A fin angle is often desired to impart a spinning motion to the dart during its flight, after deployment from the weapon system, for stabilization. Further, in this invention, the fin angle also facilitates the initiation of bending of the tapered portion of each fin, which is detached from the body of the dart upon contact of the flattened leading edge with the casing of a mine or other ordinance.

Suitable arrangements for trigger mechanisms are known and available in the art. In general, the triggering is achieved when the dart decelerates as the fins contact the case and slow down the penetration velocity of the dart. The dart body slows down but an internal floating mass, which is intentionally included in the dart design, keeps moving forward due to its inertia. A bending of the unattached part of the fins ensures a higher level of deceleration and imposes the reliability of triggering the dart, while the dart is still within the mine body, before the dart penetrates clear through the mine. Triggering of the initiation process may be adjusted to occur before or after the bending angle of the fin has progressed to an extreme position. This adjustment is made by changing the strength of the spring holding the internal floating mass in place.

Figure 4:
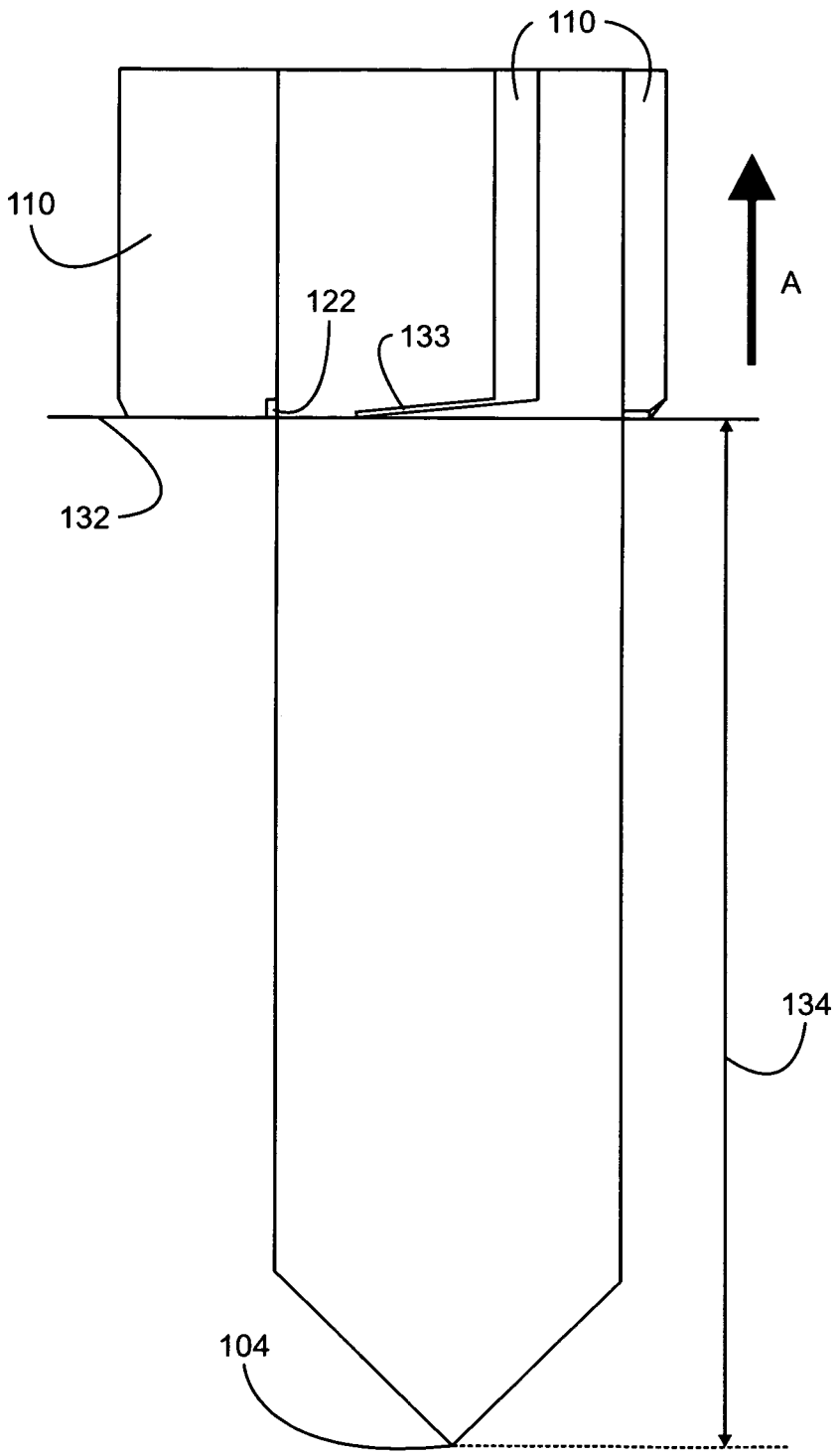
FIG. 4 is an illustration of an exemplary embodiment of a dart tail fin assembly in the process of penetrating the casing of a mine.

Referring to FIG. 4, upon deployment, the dart penetrates through any sand and/or water overburden and through the casing or housing 132 of the mine or other ordinance that is to be deactivated. As the dart body penetrates through the casing 132, the leading edge 114 of each fin contacts the casing, and each fin begins to bend along the tapered portion 133 of the fin that is detached from the dart body. Placing each fin at an angle other than 90 degrees may further aid in the initiation of the bending of each fin. The fins continue to bend until the detached tapered portion of each fin is substantially in contact with the outer surface of the casing. This placement stops penetration of the dart and moves the fins in the direction of arrow A, initiating the triggering mechanism and delivering the dart payload. The trigger mechanism is activated while the fins are bending toward the tail of the dart after penetration of the dart through a given object at a depth 134 equal to the distance from a point from which the tapered portion the fin body begins to the nose of the dart. This depth is selected to place the active materials of the dart in the proper location within the casing to deactivate or to detonate the contents of the mine or ordinance.

While it is apparent that the illustrative exemplary embodiments of the invention disclosed herein fulfill the objectives of the present invention, it is appreciated that numerous modifications and other exemplary embodiments may be devised by those skilled in the art. Additionally, feature(s) and/or element(s) from any exemplary embodiment may be used singly or in combination with other exemplary embodiment(s). Therefore, it will be understood that the appended claims are intended to cover all such modifications and exemplary embodiments, which would come within the spirit and scope of the present invention.

What is claimed is:

1. A dart tail fin assembly, comprising:

a cylindrical dart body comprising a nose, a tail opposite the nose and an outer surface extending from the nose to the tail;

a plurality of tail fins being attached to and spaced around the outer surface of the dart body, wherein each fin of the plurality of tail fins comprises a trailing edge, a leading edge, a length from the trailing edge to the leading edge, and a flat portion, wherein the trailing edge is aligned with the tail of the dart, wherein the leading edge is opposite the trailing edge toward the nose of the dart, wherein said each fin is detached from the outer surface of the dart body along a portion of the length, which extends from the leading edge, and wherein the flat portion disposed at the leading edge extends perpendicularly outward from the outer surface by a first width; and a gap existing between said each fin and the outer surface of the dart body along the portion of the length over which said each fin being detached from the outer surface.

2. The assembly of claim 1, wherein said each fin extends perpendicularly outward from the outer surface by a second width at its trailing edge, and wherein the second width is greater than the first width.

3. The assembly of claim 2, wherein said each fin further comprises a tapered section from the leading edge toward the trailing edge, and wherein the tapered section includes a width, which changes from the first width to the second width along a given distance from the leading edge.

4. The assembly of claim 2, wherein said each fin further comprises a tapered section from the leading edge toward the trailing edge, wherein the tapered section includes a width, which changes from the first width to the second width along a given distance from the leading edge, and wherein the given distance equals the portion of the length over which said each fin is detached from the outer surface of the dart body.

5. The assembly of claim 1, wherein said each fin extends along the length at angle of 90 degrees.

6. The assembly of claim 1, wherein said plurality of tail fins comprises at least three tail fins.

7. The assembly of claim 1, further comprising a trigger mechanism being located at the tail of the dart.

8. The assembly of claim 7, wherein the trigger mechanism is activated after penetration of the dart through a given object a depth equal to the point along the dart body where the portion of the length over which said each fin is detached from the outer surface of the dart body to the nose of the dart body.

9. The assembly of claim 7, further comprising an energetic material being disposed within the dart body, wherein the trigger mechanism initiates the energetic material upon activation.

10. The assembly of claim 7, further comprising a chemical being located within the dart body being capable of inactivation of energetic materials, wherein the trigger mechanism releases the chemical upon activation.

11. A dart tail fin assembly, comprising:

a cylindrical dart body comprising a nose, a tail opposite the nose and an outer surface extending from the nose to the tail;

a plurality of tail fins being attached to and spaced around the outer surface of the dart body, wherein each fin of the plurality of tail fins comprises a trailing edge, a leading edge, a length from the trailing edge to the leading edge, and a flat portion, wherein the trailing edge is aligned with the tail of the dart, wherein the leading edge is opposite the trailing edge toward the nose of the tail dart, wherein said each fin is detached from the outer surface of the dart body along a portion of the length, which extends from the leading edge, and wherein the flat portion disposed at the leading edge extends outward from the outer surface by a first width; and a gap existing between said each fin and the outer surface of the dart body along the portion of the length over which said each fin being detached from the outer surface.

12. The assembly of claim 11, wherein said each fin extends from the tail along the length at an angle other than 90 degrees.

13. The assembly of claim 12, wherein said angle other than 90 degrees is in a range of 5 degrees to 15 degrees.

* * * * *